US009177537B2

(12) United States Patent
Mori

(10) Patent No.: US 9,177,537 B2
(45) Date of Patent: Nov. 3, 2015

(54) PERCUSSION ATTACHMENT

(71) Applicant: ROLAND CORPORATION, Shizuoka (JP)

(72) Inventor: Yoshiaki Mori, Shizuoka (JP)

(73) Assignee: ROLAND CORPORATION, Shizuoka (JP)

( * ) Notice: Subject to any disclaimer, the term of this patent is extended or adjusted under 35 U.S.C. 154(b) by 155 days.

(21) Appl. No.: 14/047,038

(22) Filed: Oct. 7, 2013

(65) Prior Publication Data

US 2014/0157972 A1 Jun. 12, 2014

(30) Foreign Application Priority Data

Dec. 10, 2012 (JP) ..... 2012-269452

(51) Int. Cl.
*G10D 13/02* (2006.01)
*G10H 1/18* (2006.01)
*G10H 3/14* (2006.01)

(52) U.S. Cl.
CPC ..... *G10D 13/023* (2013.01); *G10D 13/024* (2013.01); *G10H 1/18* (2013.01); *G10H 3/146* (2013.01)

(58) Field of Classification Search
CPC ... G10D 13/023; G10D 13/02; G10D 13/025; G10D 13/00; G10D 13/028; G10D 13/024; G10D 13/026; G10D 13/022; G10D 13/027; G10D 13/006; G10D 13/04; G10D 13/06; G10D 1/00; G10D 1/10; G10D 3/04; G10D 3/02; G10D 7/005; G10H 3/12; G10H 1/32; G10H 3/01
See application file for complete search history.

(56) References Cited

U.S. PATENT DOCUMENTS

| | | | | |
|---|---|---|---|---|
| 3,897,034 | A * | 7/1975 | Stanley | 244/122 AD |
| 4,158,980 | A | 6/1979 | Gauger | |
| 4,225,107 | A | 9/1980 | Gleason | |
| 5,684,258 | A | 11/1997 | Liao | |
| 5,691,492 | A * | 11/1997 | May | 84/421 |
| 6,028,258 | A * | 2/2000 | Hicks et al. | 84/421 |
| 6,673,993 | B2 | 1/2004 | Miller | |
| 7,501,567 | B1 * | 3/2009 | Spinazzola | 84/411 R |
| 7,772,473 | B2 | 8/2010 | Shepherd | |
| 7,795,518 | B2 | 9/2010 | Yoshino et al. | |
| 7,906,718 | B1 | 3/2011 | Liao | |
| 7,919,701 | B2 | 4/2011 | Yang | |
| 8,178,768 | B1 | 5/2012 | Shepherd | |
| 2003/0000366 | A1 | 1/2003 | Miller | |
| 2003/0061932 | A1 | 4/2003 | Tanaka et al. | |

(Continued)

OTHER PUBLICATIONS

"Search Report of European Counterpart Application", issued on Mar. 19, 2014, p. 1-p. 12.

(Continued)

*Primary Examiner* — Marlon Fletcher
(74) *Attorney, Agent, or Firm* — Jianq Chyun IP Office

(57) ABSTRACT

A percussion attachment is provided to be detachably installed on a percussion instrument. The percussion attachment includes a main body part having a struck part to be struck by a player, an extended part extending from a side surface of the main body part to be locked to one of the tension bolts, and a restricting part protruding from the side surface of the main body part near the extended part and supporting the percussion instrument to restrict a displacement of the main body part in a state that the extended part is tightened together with the hoop by one of the tension bolts.

16 Claims, 4 Drawing Sheets

(56) References Cited

U.S. PATENT DOCUMENTS

| | | | | |
|---|---|---|---|---|
| 2006/0081116 | A1* | 4/2006 | Copeland et al. | 84/421 |
| 2009/0020677 | A1 | 1/2009 | Crous | |
| 2012/0103164 | A1* | 5/2012 | Wang | 84/421 |
| 2014/0026735 | A1* | 1/2014 | Sato et al. | 84/421 |
| 2014/0165822 | A1* | 6/2014 | Mori | 84/738 |

OTHER PUBLICATIONS

Lockerz, "http://web.archive.org/web/20111002122017/http://www.gaugerpercussion.com/lockerzX.html", retrived on Mar. 6, 2014, p. 1-2.

Yamaha, "http://jp.yamaha.com/products/musical-instruments/drums/accessories/wedges", retrived on Aug. 6, 2012, "WEDGE: Products lineup", with a English translation thereof, p. 1-2.

"http://www.crappytriggers.com/index.php?main_page=product_info&cPath=1&products_id=1" retrived on Aug. 6, 2012, p. 1-2, which is the web-site from "CRAPPY" shows BeatBar, Triggering Bar (for Snare or Tom) by Crappy Triggers.

"http://www.thomann.de/gb/sonor_jth_jungle_snare_halter.htm" retrived on Oct. 2, 2012, p. 1-2, which is the web-site from "Thomann UK Cyberstore" shows Sonor JTH Jungle Snare Holder.

* cited by examiner

PERCUSSION ATTACHMENT

CROSS-REFERENCE TO RELATED APPLICATIONS

This application claims the priority benefit of Japan application serial no. 2012-269452, filed on Dec. 10, 2012. The entirety of the above-mentioned patent application is hereby incorporated by reference herein and made a part of this specification.

BACKGROUND OF THE INVENTION

1. Field of the Invention

The present invention relates to a percussion attachment. In particular, the present invention relates to a percussion attachment that is adapted for suppressing damage of the hoop and preventing looseness or tightness of the tension bolt during performance, and has high versatility.

2. Description of Related Art

Percussion attachments are known to be detachably installed on percussion instruments, such as acoustic drums or electronic drums, etc. Among such percussion attachments, some may include sensors for detecting striking of the player. They may be used as electronic percussion instruments or controllers for playing or stopping songs.

For example, U.S. Pat. No. 8,178,768 discloses a percussion attachment that is tightened together with the rim (hoop) by one or two tension bolts 1 to be supported on the drum 11.

However, the aforementioned traditional percussion attachment is supported on the percussion instrument only through a part that is tightened with the rim by the tension bolts 1. For this reason, the rim receives a large stress when being struck, which easily causes damage to the rim.

Besides, in the situation that the aforementioned traditional percussion attachment is tightened together with the rim by one tension bolt 1, the tension bolt 1 may easily rotate around the axis thereof when the percussion attachment is struck. As a result, problems such as looseness or tightness of the tension bolt may occur during performance.

On the other hand, in the situation that the aforementioned traditional percussion attachment is tightened together with the rim by two tension bolts 1, the tension bolts 1 can be prevented from rotating around their axes. In that case, the percussion instruments have to satisfy certain conditions, such as a specific interval between the adjacent tension bolts 1 in the circumferential direction or a specific curvature of the rim, so that the percussion attachment can be installed thereon. Therefore, the versatility of the attachment is low.

PRIOR ART LITERATURE

Patent Literature

[Patent Literature 1] U.S. Pat. No. 8,178,768 (FIG. 1 and FIG. 4, etc.)

SUMMARY OF THE INVENTION

Considering the above, the present invention provides a percussion attachment that is adapted for suppressing damage of the hoop and preventing looseness or tightness of the tension bolt during performance, and has high versatility.

The percussion attachment of the present invention has the following effects. An extended part extending from a side surface of a main body part is tightened together with a hoop by one of a plurality of tension bolts, and in such a state, a restricting part which is disposed to protrude from the side surface of the main body part touches a percussion instrument, so as to restrict a displacement of the main body part and the extended part that results from striking on a struck part. Accordingly, the stress that occurs to the hoop when the struck part is struck can be reduced. In other words, damage of the hoop can be suppressed.

Moreover, in the state that the extended part is tightened together with the hoop by one tension bolt, the tension bolt can be prevented from rotating with the extended part around an axis thereof when the struck part is struck. Thus, the versatility of the attachment is increased, and looseness or tightness of the tension bolt during performance can be prevented. In other words, a change in the tension of the head can be avoided.

According to other aspect of the present invention, in addition to the aforementioned effects, the percussion attachment of the present invention further has the following effects. In the state that the extended part is tightened together with the hoop by one tension bolt, a portion of the tension bolt, which is between a portion locked to the extended part and a portion screwed into the lug, can be supported by a bolt supporting part that is formed under the extended part. Accordingly, the bolt supporting part can restrict the displacement of the main body part and the extended part relative to the tension bolt.

The displacement of the tension bolt is restricted by the hoop and the lug. Thus, the displacement of the main body part and the extended part relative to the tension bolt is restricted, and accordingly, the stress that occurs to the hoop when the struck part is struck can be reduced. In other words, damage of the hoop can be suppressed.

According to other aspect of the present invention, in addition to the aforementioned effects, the percussion attachment of the present invention further has the following effects. The bolt supporting part has a substantially U shape when viewed from above, which is recessed toward the main body part. In comparison with the case where the bolt supporting part touches the tension bolt through an insertion of the tension bolt into a hole that is substantially circular when viewed from above, an installation or detachment process for installing/detaching the attachment of the present invention to/from the percussion instrument is simplified.

According to other aspect of the present invention, in addition to the aforementioned effects, the percussion attachment of the present invention further has the following effects. In the state that the extended part is tightened together with the hoop by one tension bolt, the bolt supporting part is open inward in a radial direction of the hoop. Thus, the bolt supporting part can restrict the displacement of the main body part and the extended part relative to the tension bolt with certainty.

Here, if the struck part of the main body part is struck in the state that the extended part is tightened together with the hoop by one tension bolt, a force is generated to cause the displacement of the portion of the tension bolt, which is locked to the extended part, in a direction away from the hoop, namely, outward in the radial direction of the hoop. Meanwhile, a force is generated to cause the displacement of the bolt supporting part that touches the tension bolt under the extended part in a direction toward the hoop, namely, inward in the radial direction of the hoop.

By contrast thereto, in the state that the extended part is tightened together with the hoop by one tension bolt, the bolt supporting part can be opposed to the portion of the tension bolt that is under the extended part and faces in the direction away from the hoop, namely, outward in the radial direction of the hoop. Therefore, while the installation or detachment process for installing/detaching the percussion attachment of the present invention to/from the percussion instrument is simplified, the bolt supporting part can surely restrict the displacement of the main body part and the extended part relative to the tension bolt.

According to other aspect of the present invention, in addition to the aforementioned effects, the percussion attachment of the present invention further has the following effects. In the state that the extended part is tightened together with a flange supporting part of the hoop by one tension bolt, the flange supporting part touches one of a plurality of flange parts at two sides in a circumferential direction of the hoop with the tension bolt therebetween. Thus, when the struck part of the main body part is struck, the flange supporting part can restrict the tension bolt from rotating with the extended part around the axis thereof. Accordingly, change of the tension of the head resulting from looseness or tightness of the tension bolt during performance can be prevented.

According to other aspect of the present invention, in addition to the aforementioned effects, the percussion attachment of the present invention further has the following effects. The elastic part and the pressure contact part can be integrally formed using the same elastic material, so as to reduce the number of the parts.

Moreover, because a gap is formed between the pressure contact part of the flange supporting part and the main body part, the gap can be used to make the pressure contact part elastically deform easily. Therefore, even if the elastic part and the pressure contact part are made of the same elastic material, the pressure contact part can be elastically deformed more easily than the elastic part.

Accordingly, by making the elastic part less elastically deformable than the pressure contact part, elastic deformation of the elastic part resulting from the displacement of the main body part and the extended part relative to the tension bolt can be suppressed. On the other hand, by making the pressure contact part more elastically deformable than the elastic part, the pressure contact part can easily be in close contact with flange parts of various shapes. As a result, damage of the hoop can be prevented and the versatility of the attachment can be increased.

According to other aspect of the present invention, in addition to the aforementioned effects, the percussion attachment of the present invention further has the following effects. In the state that the extended part is tightened together with the hoop by one tension bolt, the rigid part that has higher stiffness than the elastic part supports the tension bolt through the elastic part. Since the elastic part touches the tension bolt, damage of the male screw of the tension bolt can be avoided. Moreover, the elastic deformation of the elastic part is restricted by the rigid part, and therefore the displacement of the main body part and the extended part relative to the tension bolt can be restricted with certainty. According to other aspect of the present invention, in addition to the aforementioned effects, the percussion attachment of the present invention further has the following effects. The main body part includes a sensor that detects striking on the struck part. Thus, the percussion attachment can be used as an electronic percussion instrument or a controller for playing or stopping a song.

DESCRIPTION OF THE EMBODIMENTS

Figure 1:
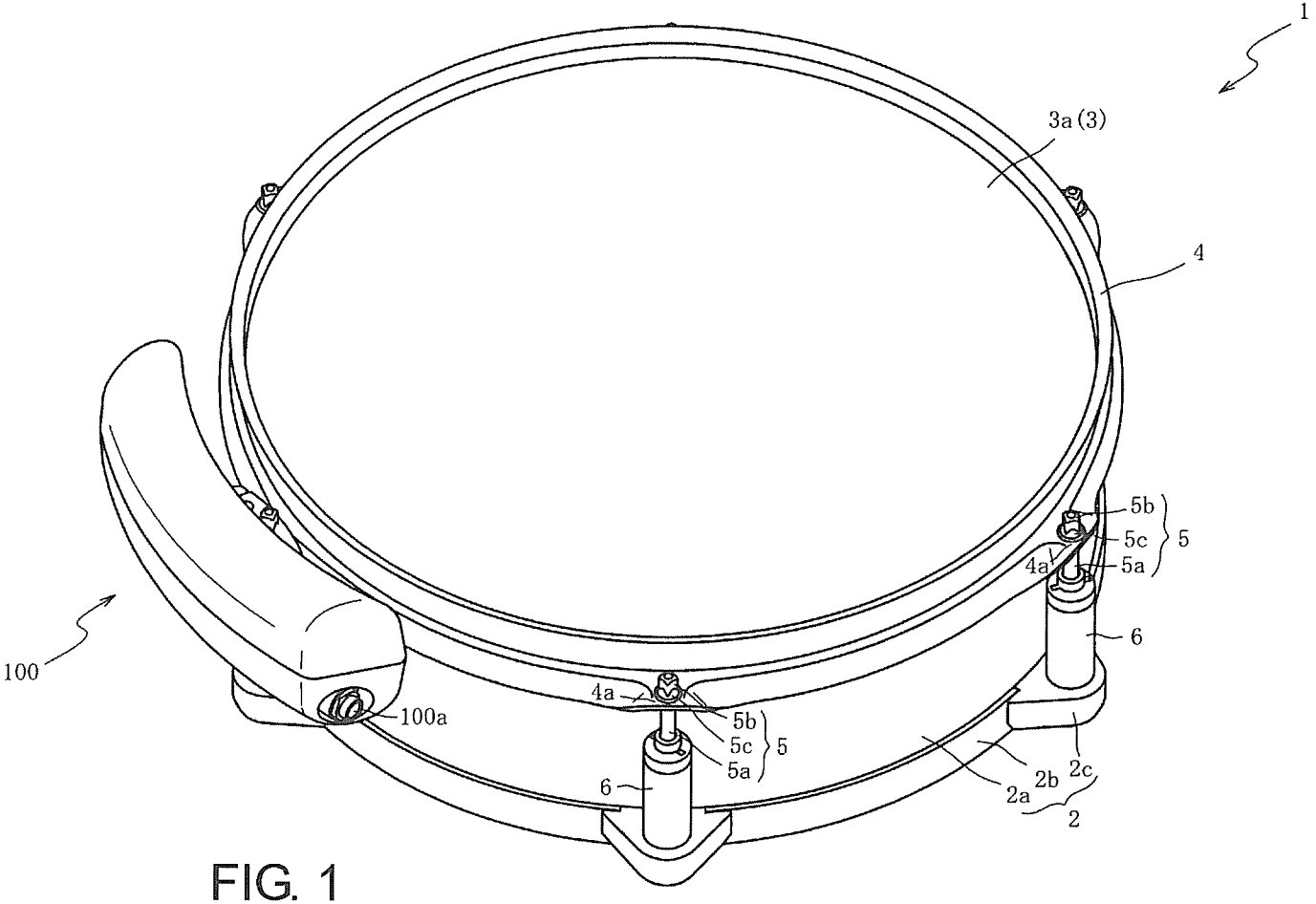
FIG. 1 is a schematic perspective view of a drum with an attachment installed thereon in an exemplary embodiment of the present invention.

Below preferable exemplary embodiments of the present invention are described in detail with reference to the affixed figures. First, referring to FIG. 1, a schematic structure of a drum 1 that has an attachment 100 installed thereon in an exemplary embodiment is described hereinafter. FIG. 1 is a schematic perspective view of the drum 1 with the attachment 100 installed thereon in an exemplary embodiment of the present invention.

The drum 1 is an electronic percussion instrument adapted to be struck by the player. As shown in FIG. 1, the drum 1 mainly includes a body part 2, a head 3, a hoop 4, tension bolts 5, and lugs 6. The body part 2 has a cylindrical shape that is open at one side. The head 3 is stretched to be installed on the one side (the upper side of FIG. 1) of the body part 2. The hoop 4 presses a peripheral part of the head 3. The tension bolts 5 apply tension on the head 3 through the hoop 4. The lugs 6 are disposed on the body part 2 and the tension bolts 5 are screwed into the lugs 6.

The body part 2 is a member that serves as the body of the drum 1, and includes a shell 2*a*, a bottom part 2*b*, and extended parts 2*c*. The shell 2*a* has a cylindrical shape that is open at one side and the other side (the upper side and lower side of FIG. 1). The bottom part 2*b* covers the other side (the lower side of FIG. 1) of the shell 2*a*. The extended parts 2*c* are formed to extend outward from the bottom part 2*b* in a radial direction of the shell 2*a*. A plurality of the extended parts 2*c* (the number is 6 in this exemplary embodiment) are disposed with equal intervals along a circumferential direction of the shell 2*a*.

Figure 4A:
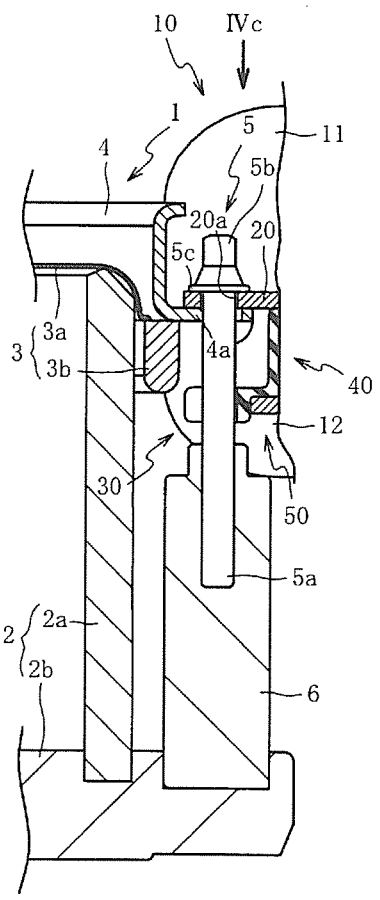
FIG. 4A is a partial cross-sectional view of a drum with an attachment installed thereon.

The head 3 includes a membrane-shaped striking surface part 3*a* and a frame part 3*b* (see FIG. 4A). The frame part 3*b* is fixed to an outer edge of the striking surface part 3*a*. The striking surface part 3*a* is a member adapted to be struck by the player. The frame part 3*b* is a member locked to the hoop 4 and is formed of a metal material that has a predetermined stiffness. The frame part 3*b* has an inner diameter that is larger than an outer diameter of the shell 2*a*. Accordingly, when the striking surface part 3*a* is installed to cover the one side of the shell 2*a*, the frame part 3*b* is pressed toward the other side (the lower side of FIG. 1) of the shell 2*a* to apply tension to the striking surface part 3*a*.

Nevertheless, it should be noted that the frame part 3*b* is not necessarily made of the metal material, and may also be made of a resin material, etc., that has the predetermined stiffness.

The hoop 4 is an annular member, which is adapted to press the frame part 3*b* of the head 3, so as to apply tension to the striking surface part 3*a*. An inner diameter of the hoop 4 is larger than the outer diameter of the shell 2*a* and smaller than an outer diameter of the frame part 3*b*. Moreover, the hoop 4 includes flange parts 4*a* and through holes 4*b* (see FIG. 4B). The flange parts 4*a* extend outward in a radial direction of the hoop 4. The through holes 4*b* are formed to pass through the flange parts 4*a* respectively. A plurality of the flange parts 4*a* and the through holes 4*b* (the number is 6 respectively in this exemplary embodiment) are disposed with equal intervals along a circumferential direction of the hoop 4. The interval between two adjacent flange parts 4*a* in the circumferential direction is set to be equal to the interval between two adjacent extended parts 2*c* of the body part 2 in the circumferential direction.

Each of the tension bolts 5 includes a male screw part 5*a*, a head part 5*b*, and an engagement part 5*c*. A male thread is formed on the male screw part 5*a*. The head part 5*b* is connected with the male screw part 5*a* at one side (the upper side of FIG. 1) in an axial direction of the male screw part 5*a*. The engagement part 5*c* extends in a flange shape at a connection portion between the male screw part 5*a* and the head part 5*b*.

An inner diameter of the through hole 4*b* of the hoop 4 is larger than an outer diameter of the male screw part 5*a* and smaller than an outer diameter of the engagement part 5*c*. Thus, by inserting the male screw part 5*a* into the through hole 4*b* from a top surface side of the flange part 5*a*, the engagement part 5*c* is locked to the top surface of the flange part 4*a*.

The lug 6 is a cylindrical member and has a female thread to be screwed to the male thread formed on the male screw part 5*a* of the tension bolt 5. The lug 6 is installed upright on the extended part 2*c* at a position apart from an outer circumferential surface of the shell 2*a* of the body part 2. An interval between two adjacent lugs 6 in the circumferential direction is set to be equal to the interval between two adjacent through holes 4*b* of the hoop 4 in the circumferential direction (see FIG. 4B). In this exemplary embodiment, the lugs 6 are installed upright on the extended parts 2*c* respectively at positions apart from the outer circumferential surface of the shell 2*a*. However, the extended parts 2*c* may be omitted, and in that case, the lugs 6 may be fixed to the outer circumferential surface of the shell 2*a*.

The engagement part 5*c* of the tension bolt 5 is locked to the flange part 4*a* of the hoop 4. In such a state, the male screw part 5*a* of the tension bolt 5 is screwed to the lug 6, and thereby the frame part 3*b* of the head 3 (see FIG. 4B) is pressed toward the other side of the body part 2 through the hoop 4. As a result, tension is applied to the striking surface part 3*a* of the head 3 of the drum 1. The player may adjust the tightness of the tension bolt 5 with respect to the lug 6, so as to set the tension applied to the striking surface part 3*a* in accordance with the player's preference.

The attachment 100 is an electronic percussion instrument. The attachment 100 is detachably installed on the drum 1 and is adapted to be struck by the player. The attachment 100 includes a sensor (not shown) and a jack 100*a*. The sensor is used to detect a vibration of the attachment 100, and the jack 100*a* is electrically connected with the sensor. The jack 100*a* and a sound source device (not shown) are electrically connected with each other via a connection cable (not shown). When the attachment 100 is struck, the vibration of the attachment 100 is detected by the sensor, and a detected signal is outputted from the jack 100*a* to the sound source device via the connection cable. As a result, the sound source device generates musical tones based on the detected signal.

Figure 2A:
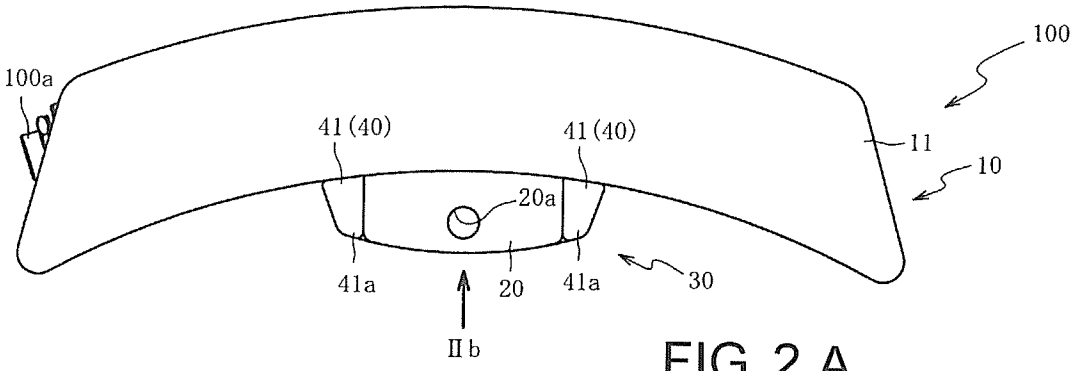
FIG. 2A is a schematic top view of the attachment.
Figure 2B:
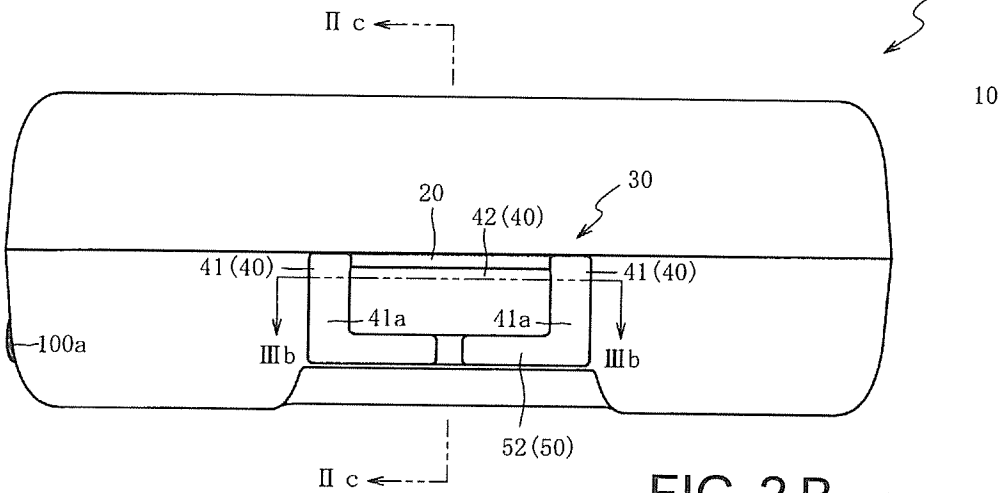
FIG. 2B is a schematic side view of the attachment when viewed from the IIb direction of FIG. 2A.
Figure 2C:
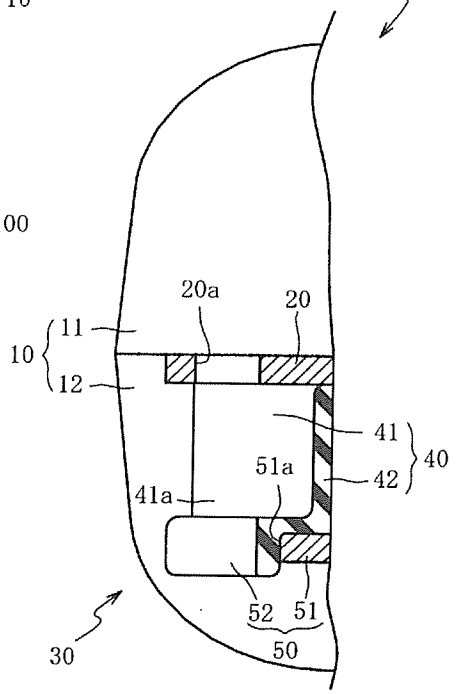
FIG. 2C is a partially enlarged cross-sectional view of the attachment along the IIc-IIc line of FIG. 2B.
Figure 3A:
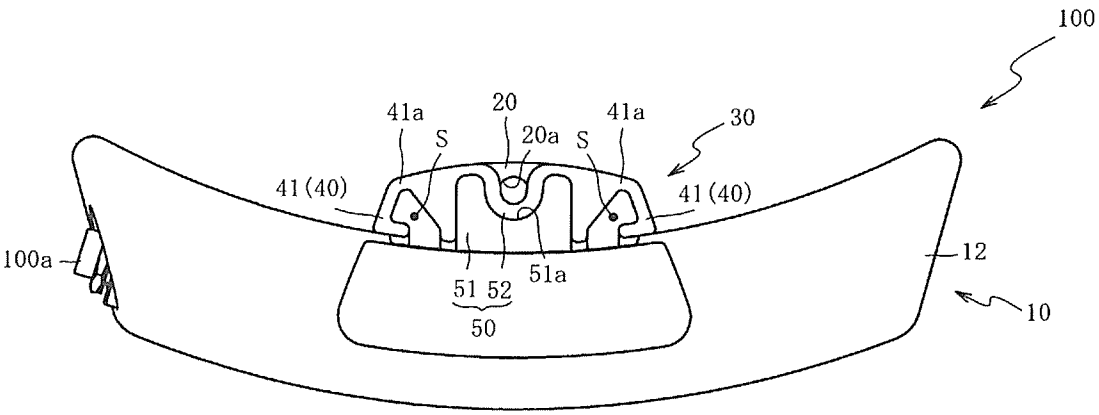
FIG. 3A is a schematic bottom view of the attachment.
Figure 3B:
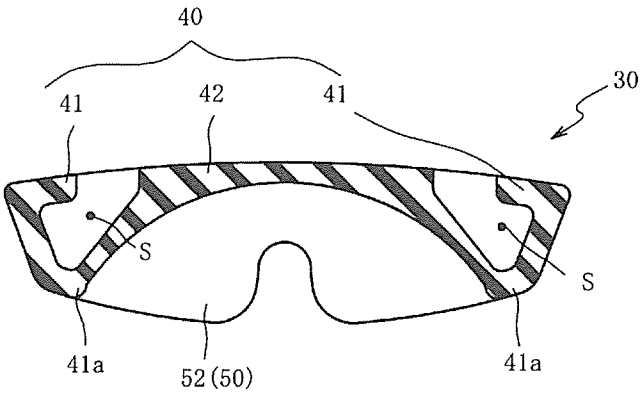
FIG. 3B is a partially enlarged cross-sectional view of the attachment along the IIIb-IIIb line of FIG. 2B.

Next, the appearance and shape of the attachment 100 are explained in detail with reference to FIG. 2A to FIG. 3B. FIG. 2A is a schematic top view of the attachment 100. FIG. 2B is a schematic side view of the attachment 100 when viewed from the IIb direction of FIG. 2A. FIG. 2C is a partially enlarged cross-sectional view of the attachment 100 along the IIc-IIc line of FIG. 2B. FIG. 3A is a schematic bottom view of the attachment 100. FIG. 3B is a partially enlarged cross-sectional view of the attachment 100 along the IIIb-IIIb line of FIG. 2B. In order to simplify the illustration and to facilitate understanding, in FIG. 2C, a part of a main body part 10 is omitted. Moreover, in FIG. 3B, the main body part 10 is also omitted.

As shown in FIG. 2A to FIG. 2C and FIG. 3A to FIG. 3B, the attachment 100 mainly includes the main body part 10, a plate 20, and a restricting part 30. The main body part 10 has a rod shape that is curved into an arc. The plate 20 extends inward (the lower side of FIG. 2A) in a radial direction from an inner circumferential surface of the main body part 10 (the surface at the lower side of FIG. 2A). The restricting part 30 is disposed near the plate 20 and protrudes inward in the radial direction from an inner circumferential surface of the main body part 10.

The main body part 10 is a member that serves as a main body portion of the attachment 100, and includes an upper main body part 11 and a lower main body part 12. The upper main body part 11 constitutes an upper portion of the main body part 10, and the lower main body part 12 is connected to a bottom surface of the upper main body part 11 and constitutes the lower portion of the main body part 10.

The upper main body part 11 is a member adapted to be struck by the player and is made of a rubber material. The lower main body part 12 is a member made of a resin material. The jack 100*a* is installed at an end side (the left side of FIG. 2A) of a longitudinal direction of the lower main body part 12. In this exemplary embodiment, the upper main body part 11 is made of the rubber material; however, the upper main body part 11 may also be formed using other materials, such as an elastomer or a foaming agent. Moreover, in this exemplary embodiment, the lower main body part 12 is made of the resin material; however, the lower main body part 12 may also be formed using other materials, such as a thin iron plate or aluminum, etc.

Figure 4B:
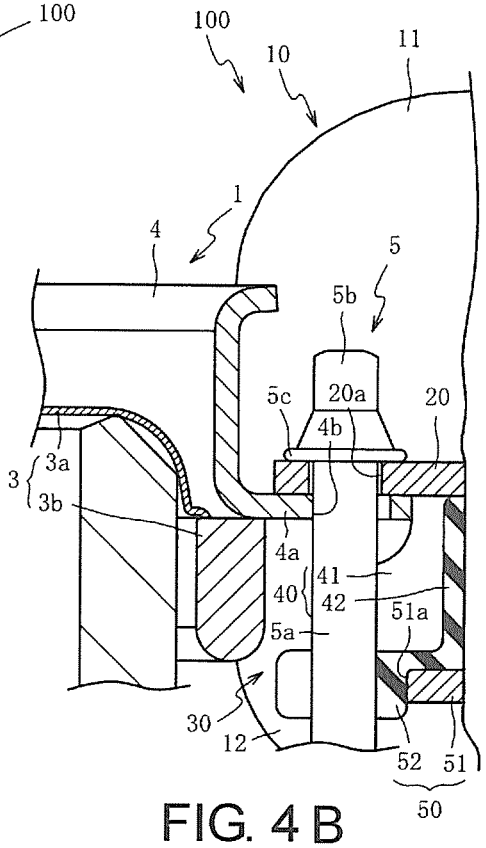
FIG. 4B is a partially enlarged cross-sectional view of the drum with the attachment installed thereon.

The plate 20 is a member tightened together with the flange part 4*a* of the hoop 4 by the tension bolt 5 (see FIG. 4B). The plate 20 is made of a plate-shaped metal material. A locking hole 20*a* is formed in the plate 20. An inner diameter of the locking hole 20*a* is larger than an outer diameter of the male screw part 5*a* of the tension bolt 5 and smaller than an outer diameter of the engagement part 5*c*. By inserting the male screw part 5*a* of the tension bolt 5 into the locking hole 20*a*, the engagement part 5*c* is locked to the plate 20 (see FIG. 4B).

The restricting part 30 is a member that restricts the displacement of the main body part 10 and the plate 20 relative to the drum 1 (see FIG. 1). The restricting part 30 includes a flange supporting part 40 and a bolt supporting part 50. The flange supporting part 40 supports the flange part 4*a* of the hoop 4 (see FIG. 4B), and the bolt supporting part 50 supports the male screw part 5*a* of the tension bolt 5 (see FIG. 4B).

The flange supporting part 40 is a member made of an elastic material, and includes a pair of protrusion parts 41 and a connection part 42. The protrusion parts 41 are disposed to protrude inward (the left side of FIG. 2C) in the radial direction from the inner circumferential surface of the main body part 10 (the surface at the left side of FIG. 2C). In addition, the protrusion parts 41 are separated by a predetermined interval in the circumferential direction of the main body part 10. The connection part 42 is connected between the pair of protrusion parts 41. Besides, the connection part 42 is recessed outward (the right side of FIG. 2C) in the radial direction of the main body part 10.

The protrusion parts 41 are members for supporting the flange part 4*a* of the hoop 4 (see FIG. 4C) and respectively include pressure contact parts 41*a*. The pressure contact part

41*a* is a member that is to be pressure-contacted by the flange part 4*a*. The pressure contact part 41*a* is formed at a front end portion of the protrusion part 41 in a protrusion direction thereof (the downward direction of FIG. 3B). A gap S is formed between the pressure contact part 41*a* and the main body part 10. Moreover, by recessing the connection part 42 outward in the radial direction of the main body part 10, the flange part 4*a* can be received in a space surrounded by the plate 20 and the pair of protrusion parts 41.

The bolt supporting part 50 includes a rigid part 51 and an elastic part 52. The rigid part 51 is disposed to protrude from the inner circumferential surface of the main body part 10 (the surface at the upper side of FIG. 3A). The elastic part 52 is disposed to cover a front end portion of the rigid part 51 in a protrusion direction thereof (the upward direction of FIG. 3A).

The rigid part 51 is a member that restricts the displacement of the main body part 10 and the plate 20 relative to the tension bolt 5 (see FIG. 4A). The rigid part 51 is made of a metal material that has a predetermined stiffness, and the rigid part 51 includes a recess part 51*a* that is recessed at the front end portion of the rigid part 51 in the protrusion direction thereof. Moreover, a recess bottom surface of the recess part 51*a* has an arc shape and looks like a "U" when viewed from above.

The arc-shaped portion of the recess part 51*a* is formed to be concentric with the locking hole 20*a* of the plate 20. In addition, an inner diameter of the arc-shaped portion is larger than the outer diameter of the male screw part 5*a* of the tension bolt 5 (see FIG. 4A).

The rigid part 51 is formed integrally with the plate 20 using the same metal material as the plate 20. Moreover, the upper main body part 11 and the lower main body part 12 are fixed in a state that a portion connecting the rigid part 51 and the plate 20 is received inside the main body part 10. Accordingly, in comparison with the case that the rigid part 51 and the plate 20 are formed separately, the number of the parts can be reduced. In addition, it is not required to align the positions of the recess part 51*a* of the rigid part 51 and the locking hole 20*a* of the plate 20, and therefore, the production efficiency of the attachment 100 can be improved.

The elastic part 52 is a member that touches the male screw part 5*a* of the tension bolt 5 (see FIG. 4A). The elastic part 52 is made of an elastic material that has lower stiffness than the rigid part 51. The elastic part 52 is recessed like a "U" when viewed from above and formed conformal with the shape of the recess part 51*a* of the rigid part 51. An arc-shaped portion of the elastic part 52 is formed to be concentric with the locking hole 20*a* of the plate 20. Furthermore, an inner diameter of the arc-shaped portion is set to be smaller than the outer diameter of the male screw part 5*a* of the tension bolt 5.

The elastic part 52 is formed integrally with the flange supporting part 40 using the same elastic material as the flange supporting part 40. Thus, the number of the parts can be reduced. In addition, the gap S is formed between the pressure contact part 41*a* of the flange supporting part 40 and the main body part 10. With the gap S, the pressure contact part 41*a* can be elastically deformed easily. Therefore, even though the flange supporting part 40 and the elastic part 52 are made of the same elastic material, the pressure contact part 41*a* can be elastically deformed more easily than the elastic part 52.

Figure 4C:
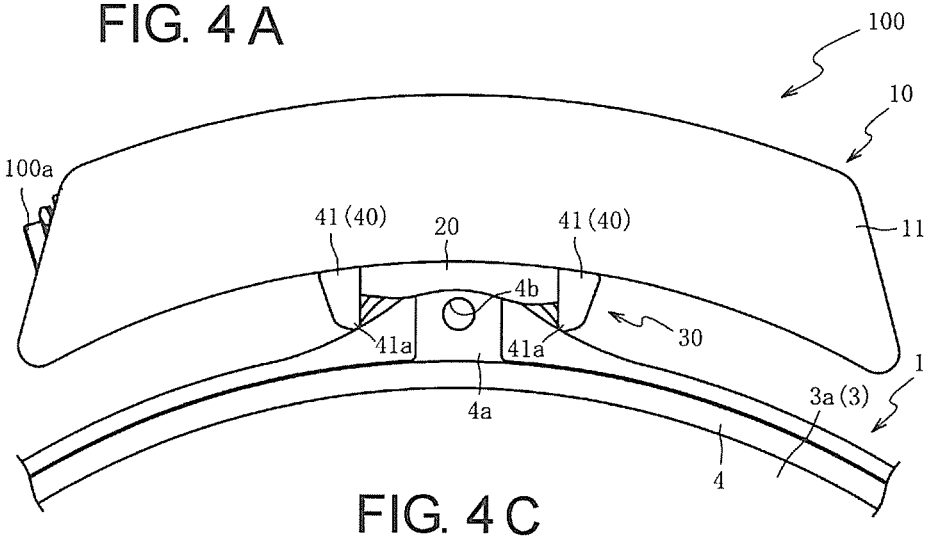
FIG. 4C is a schematic top view of the drum when viewed from the IVc direction indicated by the arrow of FIG. 4A.

Next, with reference to FIGS. 4A-4C, an installation state of the attachment 100 on the drum 1 is explained hereinafter. FIG. 4A and FIG. 4B are partial cross-sectional views of the drum 1 with the attachment 100 installed thereon. FIG. 4C is a schematic top view of the drum 1 when viewed from the IVc direction of FIG. 4A. Moreover, FIG. 4A and FIG. 4B illustrate cross-sections along a plane that includes an axle center of the tension bolt 5, which tightens the attachment 100 together with the hoop 4, and an axle center of the hoop 4. FIG. 4B further enlarges a part of FIG. 4A. In order to simplify the illustration and facilitate the understanding, in FIG. 4A and FIG. 4B, a part of the main body part 10 is omitted, and in FIG. 4C, a part of the plate 20 is omitted.

As illustrated in FIG. 4A to FIG. 4C, when the attachment 100 is installed on the drum 1, the plate 20 is placed on the top surface of the flange part 4*a* of the hoop 4. In such a state, the male screw part 5*a* of the tension bolt 5 is inserted into the locking hole 20*a* of the plate 20 and the through hole 4*b* of the hoop 4. Furthermore, the male screw part 5*a* is screwed into the lug 6. Meanwhile, with respect to the restricting part 30, the pressure contact part 41*a* of the flange supporting part 40 is in pressure contact with the flange part 4*a*. Moreover, the elastic part 52 of the bolt supporting part 50 touches the male screw part 5*a* of the tension bolt 5.

As the male screw part 5*a* is screwed into the lug 6, the engagement part 5*c* of the tension bolt 5 is locked to the plate 20. Besides, the engagement part 5*c* presses the frame part 3*b* of the head 3 toward the other side (the lower side of FIG. 4A) of the shell 2*a* via the plate 20 and the hoop 4. Through adjustment of the tightness of the tension bolt 5 on the lug 6, the player can set the tension of the striking surface part 3*a* according to the player's preference. At the same time, the plate 20 is tightened together with the flange part 4*a* by the tension bolt 5, so as to install the attachment 100 on the drum 1.

The rigid part 51 and the elastic part 52 of the bolt supporting part 50 of the attachment 100 are recessed outward (the right side of FIG. 4A) in the radial direction of the main body part 10. In other words, the bolt supporting part 50 is open inward (the left side of FIG. 4A) in the radial direction of the main body part 10. Therefore, an installation or detachment process of the attachment 100 relative to the drum 1 can be simplified. Alternatively, a hole, which has a substantially circular shape when viewed from above, may be formed in the bolt supporting part of the attachment 100. By inserting the male screw part 5*a* of the tension bolt 5 into this hole, the bolt supporting part can touch the male screw part 5*a*.

Here, among hoops that are used for various percussion instruments, some may have flange parts whose top surfaces incline outward in the radial direction. In such a case, when the plate 20 is placed on the top surface of the flange part and tightened together with the flange part, the plate 20 and the main body part 10 are installed in a state that they incline outward in the radial direction of the hoop.

By contrast, in the attachment 100, the recess part 51*a* of the rigid part 51 and the arc-shaped portion of the elastic part 52 are formed to be concentric with the locking hole 20*a* of the plate 20, so as to install the plate 20 perpendicular to the axle center of the tension bolt 5, and by screwing the tension bolt 5 into the lug 6, the axle center of the tension bolt 5 can be consistent with an axle center direction of the hoop 4. Accordingly, even if the top surface of the flange part inclines outward in the radial direction, by installing the plate 20 perpendicular to the axle center of the tension bolt 5, the plate 20 and the main body part 10 can be installed horizontally in the radial direction of the hoop 4.

The pressure contact parts 41*a* are in pressure contact with the flange part 4*a* at two sides thereof along the circumferential direction of the hoop 4 with the tension bolt 5 therebetween. Therefore, when the upper main body part 11 of the main body part 10 is struck, the flange supporting part 40 of the restricting part 30 can restrict the rotation of the tension bolt 5 together with the main body part 10 and the plate 20 around the axis, so as to prevent the tension of the striking surface part 3*a* of the head 3 from changing due to the looseness or tightness of the tension bolt 5 during performance and further to prevent the main body part 10 from rattling due to the looseness of the tension bolt 5.

Moreover, the pressure contact parts 41*a* are in pressure contact with the flange part 4*a* under the plate 20. Therefore, the displacement of the upper main body part 11 away from the hoop 4 due to the striking on the upper main body part 11 of the main body part 10 can be restricted, and the stress applied on the flange part 4*a* when the upper main body part 11 is struck can be reduced. In other words, damage of the hoop 4 can be suppressed.

Here, given that the restricting part touches the shell of the body part, the dimensions of the protrusion of the restricting part from the inner circumferential surface of the main body part 10 need to be set in accordance with a distance between the tension bolt and the outer circumferential surface of the shell. However, the distance between the tension bolt and the outer circumferential surface of the shell may vary depending on the overall shape of the percussion instrument. For this reason, the versatility of the attachment is low.

Meanwhile, the distance between the flange part of the hoop and the tension bolt is shorter than the distance between the outer circumferential surface of the shell and the tension bolt. In addition, even in the case that the hoop has different curvatures or the percussion instrument has different overall shapes, the shape of the flange part is seldom different.

In comparison with the situation that the restricting part 30 touches the shell 2*a*, the flange supporting part 40 of this exemplary embodiment touches the flange part 4*a*, and thus the versatility of the attachment 100 can be increased.

In the state that the plate 20 is tightened together with the hoop 4 by the tension bolt 5, the bolt supporting part 50 formed under the plate 20 supports a portion of the male screw part 5*a* of the tension bolt 5, which is between a portion locked to the plate 20 and a portion screwed into the lug 6.

Here, when the upper main body part 11 of the main body part 10 is struck, a force is generated to cause displacement of the main body part 10 and the plate 20 in a direction away from the hoop 4 (outward in the radial direction of the hoop 4; the right side of FIG. 4A), and meanwhile a force is generated to cause the displacement of the bolt supporting part 50, which touches the male screw part 5*a* under the plate 20, in a direction toward the hoop 4 (inward in the radial direction of the hoop 4; the left side of FIG. 4A).

By contrast, the bolt supporting part 50 is formed to have a substantially "U" shape when viewed from above, which is recessed outward (the right side of FIG. 4A) in the radial direction of the main body part 10, so that the bolt supporting part 50 can be opposite to a portion of the tension bolt 5, which faces outward in the radial direction of the hoop 4. Accordingly, when the upper main body part 11 is struck and generates a force that causes an outward displacement of the bolt supporting part 50 in the radial direction of the hoop 4, the bolt supporting part 50 can touch the male screw part 5*a*. Therefore, an installation or detachment process of the attachment 100 to the drum 1 can be simplified, and the displacement of the main body part 10 and the plate 20 relative to the tension bolt 5 can be restricted with certainty.

The displacement of the tension bolt 5 is restricted by locking the engagement part 5*c* onto the hoop 4 and screwing the male screw part 5*a* into the lug 6. Accordingly, the displacement of the main body part 10 and the plate 20 relative to the tension bolt 5 can be restricted, and the stress that occurs to the hoop 4 when the upper main body part 11 of the main body part 10 is struck can be reduced. In other words, damage of the hoop 4 can be suppressed.

Moreover, the bolt supporting part 50 of the restricting part 30 is formed in a way that the elastic part 52 touches the male screw part 5*a* of the tension bolt 5, and the arc-shaped portion of the elastic part 52 is formed to be concentric with the locking hole 20*a* of the plate 20. Further, the bolt supporting part 50 of the restricting part 30 is formed in a way that the inner diameter of the arc-shaped portion of the elastic part 52 is smaller than the outer diameter of the male screw part 5*a* of the tension bolt 5. Therefore, damage of the male screw part 5*a* can be prevented.

Besides, the entirety of the recess bottom surface of the elastic part 52, which is formed into an arc shape, can touch the male screw part 5*a*, so as to prevent a rotation of the tension bolt 5 around the axis thereof during performance and prevent looseness or tightness of the tension bolt 5 with more certainty. Moreover, since the elastic part 52, made of an elastic material, is used to touch the male screw part 5*a*, a range of the outer diameter of the tension bolt 5, in which the tension bolt 5 can be used for the present invention, is widened. That is to say, the versatility of the attachment 100 can be increased.

In addition, the rigid part 51 which has higher stiffness than the elastic part 52 supports the male screw part 5*a* of the tension bolt 5 through the elastic part 52. Thus, the bolt supporting part 50 can restrict the displacement of the main body part 10 and the plate 20 relative to the tension bolt 5.

That is, given that the bolt supporting part 50 is completely made of a high elastic material, when the upper main body part 11 of the main body part 10 is struck, a force is generated to cause the displacement of the main body part 10 relative to the tension bolt 5, and elastically deform the bolt supporting part 50 easily. In other words, the displacement of the main body part 10 cannot be restricted properly. On the other hand, in the case that the bolt supporting part 50 is completely made of a material of high stiffness, the displacement of the main body part 10 can be restricted, but the male thread formed on the male screw part 5*a* may be easily damaged, and the outer diameter of the usable tension bolt 5 becomes limited. In other words, the versatility of the attachment 100 is low.

By contrast thereto, the rigid part 51 that has higher stiffness than the elastic part 52 supports the male screw part 5*a* of the tension bolt 5 through the elastic part 52. Therefore, the elastic deformation of the elastic part 52 can be restricted by the rigid part 51 and damage of the male screw part 5*a* can also be avoided.

Moreover, in the flange supporting part 40, the gap S is formed between the pressure contact part 41*a* of the protrusion part 41 and the main body part 10, so that the pressure contact part 41*a* can be elastically deformed more easily than the elastic part 52. By making the elastic part 52 less elastically deformable than the pressure contact part 41*a*, elastic deformation of the elastic part 52 resulting from the displacement of the main body part 10 and the plate 20 relative to the tension bolt 5 can be suppressed. On the other hand, by making the pressure contact part 41*a* more elastically deformable than the elastic part 52, the pressure contact part 41*a* can easily be in close contact with flange parts of various shapes. As a result, damage of the tension bolt 5 and the hoop 4 is prevented and the versatility of the attachment 100 is increased.

As described above, in the state that the plate 20 is tightened together with the hoop 4 by one tension bolt 5, the restricting part 30 that protrudes from the inner circumferential surface of the main body part 10 touches the flange part 4*a* and the male screw part 5*a*. Thus, the attachment 100 can restrict the displacement of the main body part 10 and the plate 20, resulting from the striking on the upper main body part 11 of the main body part 10, with the restricting part 30. As a result, the stress that occurs to the hoop 4 when the upper main body part 11 is struck can be reduced. Namely, damage of the hoop 4 can be suppressed.

In addition, while the plate 20 is tightened together with the hoop 4 by one tension bolt 5, the tension bolt 5 can be prevented from rotating with the plate 20 around the axis thereof when the upper main body part 11 is struck. In comparison with a situation of using two tension bolts 5 to tighten the plate 20 with the hoop 4, the attachment 100 has higher versatility. Moreover, looseness or tightness of the tension bolt 5 can also be avoided to prevent the tension of the striking surface part 3*a* of the head 3 from changing during performance.

The above illustrates the present invention on the basis of the exemplary embodiments. However, it should be understood that the present invention is not limited to any of the exemplary embodiments, and various modifications or alterations may be made without departing from the spirit of the present invention.

In the aforementioned exemplary embodiments, the attachment 100 is installed on an electronic percussion instrument, for example. However, the present invention is not limited thereto. The attachment 100 may also be installed on an acoustic percussion instrument.

In the aforementioned exemplary embodiments, the attachment 100 is used as an electronic percussion instrument that includes a sensor for detecting striking on the upper main body part 11. However, the present invention is not limited thereto. The attachment 100 may also be used as a controller for playing or stopping a song when the sensor detects striking on the attachment 100. Moreover, the attachment 100 may be used as the so-called acoustic percussion instrument that does not have a sensor and generates an impact sound when the upper main body part is struck. In that case, the upper main body part may be made of a metal material or wood, etc., and the shape or size of the upper main body part may be varied properly to change the impact sound that is generated when the upper main body part is struck.

In the aforementioned exemplary embodiments, the main body part 10 is curved in an arc shape. However, the present invention is not limited thereto. The main body part 10 may have other shapes, e.g. a straight shape.

In the aforementioned exemplary embodiments, the restricting part 30 includes the flange supporting part 40 that touches the flange part 4*a* of the hoop 4 and the bolt supporting part 50 that touches the male screw part 5*a* of the tension bolt 5. However, the present invention is not limited thereto. The restricting part 30 may include only one of the flange supporting part 40 and the bolt supporting part 50, so as to simplify the structure of the attachment 100 and reduce the production costs. Moreover, the restricting part 30 may include a shell supporting part provided to touch the outer circumferential surface of the shell 2*a* of the body part 2. The shell supporting part may be made of the same rubber material as the flange supporting part 40, for example. In the state that the plate 20 is tightened together with the hoop 4 by the tension bolt 5, the shell supporting part may extend from the inner circumferential surface of the main body part 10 to touch the outer circumferential surface of the shell 2*a* at a position whose height allows the shell supporting part to touch the shell 2*a*. In that case, the length of the shell supporting part in an extending direction thereof may be adjustable according to the shape of the percussion instrument to which the attachment is installed. For example, a member may be detachably attached to the shell supporting part through a bolt, etc., and the shell supporting part may support the shell 2*a* through the member. In addition, the shell supporting part may be detachably attached to the inner circumferential surface of the main body part 10 through a bolt, etc., and the shell supporting part may be attached according to the shape of the percussion instrument on which the attachment is installed. The aforementioned shell supporting part may be used to replace the flange supporting part 40 or the bolt supporting part 50, or be used together with the flange supporting part 40 or the bolt supporting part 50.

In the aforementioned exemplary embodiments, the flange supporting part 40 and the elastic part 52 of the bolt supporting part 50 are integrally formed using the same elastic material. However, the present invention is not limited thereto. The flange supporting part 40 and the elastic part 52 may be formed separately. Moreover, the flange supporting part 40 and the elastic part 52 may be made of elastic materials that are different in elasticity, such that the elasticity of the flange supporting part 40 and the elastic part 52 can be set at will.

In the aforementioned exemplary embodiments, the plate 20 and the rigid part 51 of the bolt supporting part 50 are integrally formed using the same metal material. However, the present invention is not limited thereto. The plate 20 and the bolt supporting part 50 may be formed separately. Moreover, the plate 20 and the bolt supporting part 50 may be made of different materials. The rigid part 51 may be made of a material that at least has higher stiffness than the elastic part 52. The rigid part 51 may also be made of a resin material, such as ABS, etc., instead of a metal material. Moreover, in the aforementioned exemplary embodiments, the plate-shaped plate 20 extending from the inner circumferential surface of the main body part 10 is tightened together with the hoop 4 by one tension bolt 5. However, the present invention is not limited thereto. Instead, a cylindrical member may extend from the inner circumferential surface of the main body part 10 in replacement of the plate-shaped plate 20, and the cylindrical member may be tightened together with the hoop 4 by one tension bolt 5. An inner diameter of the cylindrical member is larger than the outer diameter of the male screw part 5*a* of the tension bolt 5 and smaller than the outer diameter of the engagement part 5*c*. In addition, the cylindrical member has dimensions of a predetermined height in an insertion direction (the vertical direction of FIG. 4B) of the male screw part 5*a*. Accordingly, in comparison with the plate-shaped plate 20, the cylindrical member can ensure the width of the contact area that the cylindrical member touches the male screw part 5*a* of the tension bolt 5. When the upper main body part 11 is struck and generates a force that causes displacement of the main body part 10 in a direction away from the hoop 4, the force applied on the male screw part 5*a* can be dispersed by the cylindrical member. Thus, damage of the tension bolt 5 can be easily avoided.

In the aforementioned exemplary embodiments, the bolt supporting part 50 includes the rigid part 51 and the elastic part 52 that has higher elasticity than the rigid part 51. However, the present invention is not limited thereto. The bolt supporting part 50 may include only one of the rigid part 51 and the elastic part 52, so as to simplify the structure of the bolt supporting part 50 and reduce the production costs. In that case, the inner diameter of the recess part 51*a* of the rigid part 51 may be substantially equal to the outer diameter of the male screw part 5*a* of the tension bolt 5, so that the displacement of the main body part 10 and the plate 20 relative to the tension bolt 5 can be restricted with certainty.

In the aforementioned exemplary embodiments, the bolt supporting part 50 has a substantially "U" shape when viewed from above. However, the present invention is not limited thereto. The bolt supporting part may also be formed to have a substantially "V" shape or "C" shape with corners similar to "[" when viewed from above. Moreover, a hole, which has a substantially circular shape when viewed from above, may be formed on the bolt supporting part to receive the male screw part 5*a* of the tension bolt 5, and by inserting the male screw part 5*a* into the hole, the bolt supporting part may touch the male screw part 5*a*.

If the bolt supporting part is formed in the substantially "V" shape when viewed from above, the bolt supporting part can touch the outer circumferential surface of the male screw part 5*a* of the tension bolt 5 at two positions. Thus, a range of the outer diameter of the male screw part 5*a*, in which the male screw part 5*a* can touch the bolt supporting part, is widened. In other words, the versatility of the attachment is increased. If the bolt supporting part is formed with the substantially circular hole thereon, and the male screw part 5*a* is inserted thereinto, the bolt supporting part can be opposed to the entire outer circumferential surface of the male screw part 5*a*, so that displacement of the main body part 10 and the plate 20 relative to the tension bolt 5 can be restricted with certainty.

In the aforementioned exemplary embodiments, the flange supporting part 40 is formed lower than the plate 20 and touches the flange part 4*a* of the hoop 4 under the plate 20. However, the present invention is not limited thereto. The flange supporting part 40 may also be formed higher than the plate 20 and touch the flange part 4*a* above the plate 20.

The aforementioned exemplary embodiments illustrate that, in the state that the plate 20 is tightened together with the hoop 4 by the tension bolt 5, the flange supporting part 40 touches the flange part 4*a* of the hoop 4. However, the present invention is not limited thereto. The flange supporting part may touch a portion other than the flange part 4*a* of the hoop 4, namely, the outer circumferential surface of the arc-shaped portion formed between adjacent flange parts 4*a*.

According to the aforementioned exemplary embodiments, the plate 20 is tightened together with the hoop 4 by the tension bolt 5 in the state that the plate 20 is placed on the top surface of the flange part 4*a* of the hoop 4. However, the present invention is not limited thereto. The plate 20 may be tightened together with the hoop 4 by the tension bolt 5 when a spacer is inserted between the flange part 4*a* and the plate 20, wherein the spacer may be made of a material, e.g. elastomer, which has lower stiffness than the metal material that forms the plate 20 and the hoop 4. Accordingly, damage that may easily occur due to the contact between metal materials can be prevented, and looseness of the tension bolt 5, which results from rattling of the main body part 10 relative to the flange part 4*a*, can be prevented as well.

What is claimed is:

1. A percussion attachment detachably installed on a percussion instrument, which comprises a body part having a cylindrical shape that is open at one side, a head stretched to be installed at the one side of the body part, a hoop pressing a peripheral part of the head, a plurality of tension bolts applying a tension to the head through the hoop, and a plurality of lugs which are installed on the body part and into which the plurality of tension bolts are screwed respectively, the percussion attachment comprising:

a main body part comprising a struck part to be struck by a player;

an extended part extending from a side surface of the main body part to be locked to one of the plurality of tension bolts; and a restricting part protruding from the side surface of the main body part near the extended part and supporting the percussion instrument to restrict a displacement of the main body part in a state that the extended part is tightened together with the hoop by using one of the plurality of tension bolts, wherein the restricting part comprises a bolt supporting part, which is formed lower than the extended part and touches the one of the plurality of tension bolts in the state that the extended part is tightened together with the hoop by the one of the plurality of tension bolts.

2. The percussion attachment according to claim 1, wherein the bolt supporting part has a substantially U shape when viewed from above and is recessed toward the main body part.

3. The percussion attachment according to claim 1, wherein the bolt supporting part is open inward in a radial direction of the hoop in the state that the extended part is tightened together with the hoop by the one of the plurality of tension bolts.

4. The percussion attachment according to claim 1, wherein:

the bolt supporting part comprises an elastic part, which is made of an elastic material and touches the one of the plurality of tension bolts in the state that the extended part is tightened together with the hoop by the one of the plurality of tension bolts, and a rigid part, which is made of a material having higher stiffness than the elastic part and protrudes from the side surface of the main body part, wherein the rigid part is supported by the one of the plurality of tension bolts through the elastic part in the state that the extended part is tightened together with the hoop by the one of the plurality of tension bolts.

5. The percussion attachment according to claim 4, wherein the extended part and the rigid part are integrally formed using a same metal material.

6. The percussion attachment according to claim 1, wherein the main body part comprises a sensor, which detects striking on the struck part.

7. A percussion attachment detachably installed on a percussion instrument, which comprises a body part having a cylindrical shape that is open at one side, a head stretched to be installed at the one side of the body part, a hoop pressing a peripheral part of the head, a plurality of tension bolts applying a tension to the head through the hoop, and a plurality of lugs which are installed on the body part and into which the plurality of tension bolts are screwed respectively, the percussion attachment comprising:

a main body part comprising a struck part to be struck by a player;

an extended part extending from a side surface of the main body part to be locked to one of the plurality of tension bolts; and a restricting part protruding from the side surface of the main body part near the extended part and supporting the percussion instrument to restrict a displacement of the main body part in a state that the extended part is tightened together with the hoop by using one of the plurality of tension bolts, wherein the hoop comprises a plurality of flange parts respectively extending in a flange shape outward in the radial direction to be locked to the plurality of tension bolts, and the restricting part comprises a flange supporting part, which touches one of the plurality of flange parts at two sides in a circumferential direction with the one of the plurality of tension bolts therebetween in the state that the extended part is tightened together with one of the plurality of flange parts of the hoop by the one of the tension bolts.

8. The percussion attachment according to claim 7, wherein:

the restricting part comprises a bolt supporting part, which is formed lower than the extended part and comprises an elastic part that is made of an elastic material and touches the one of the plurality of tension bolts in the state that the extended part is tightened together with the hoop by the one of the plurality of tension bolts, and the flange supporting part comprises a pressure contact part, which is made of an elastic material and is in pressure contact with the one of the plurality of flange parts in the state that the extended part is tightened together with the hoop by the one of the plurality of tension bolts, wherein the elastic part and the pressure contact part are integrally formed using the same elastic material, and a gap is formed between the pressure contact part and the main body part.

9. A percussion attachment detachably installed on a percussion instrument, which comprises a plurality of tension bolts applying a tension to a head through a hoop, the percussion attachment comprising:

a main body part comprising a struck part to be struck by a player;

an extended part extending from a side surface of the main body part to be locked to one of the plurality of tension bolts; and a restricting part protruding from the side surface of the main body part near the extended part and supporting the percussion instrument to restrict a displacement of the main body part in a state that the extended part is tightened together with the hoop by the one of the plurality of tension bolts, wherein the restricting part comprises a bolt supporting part, which is formed lower than the extended part and touches the one of the plurality of tension bolts in the state that the extended part is tightened together with the hoop by the one of the plurality of tension bolts.

10. The percussion attachment according to claim 9, wherein the bolt supporting part has a substantially U shape when viewed from above and is recessed toward the main body part.

11. The percussion attachment according to claim 9, wherein the bolt supporting part is open inward in a radial direction of the hoop in the state that the extended part is tightened together with the hoop by the one of the plurality of tension bolts.

12. The percussion attachment according to claim 9, wherein:

the bolt supporting part comprises an elastic part, which is made of an elastic material and touches the one of the plurality of tension bolts in the state that the extended part is tightened together with the hoop by the one of the plurality of tension bolts, and a rigid part, which is made of a material having higher stiffness than the elastic part and protrudes from the side surface of the main body part, wherein the rigid part is supported by the one of the plurality of tension bolts through the elastic part in the state that the extended part is tightened together with the hoop by the one of the plurality of tension bolts.

13. The percussion attachment according to claim 12, wherein the extended part and the rigid part are integrally formed using a same metal material.

14. The percussion attachment according to claim 9, wherein the main body part comprises a sensor, which detects striking on the struck part.

15. A percussion attachment detachably installed on a percussion instrument, which comprises a plurality of tension bolts applying a tension to a head through a hoop, the percussion attachment comprising:

a main body part comprising a struck part to be struck by a player;

an extended part extending from a side surface of the main body part to be locked to one of the plurality of tension bolts; and a restricting part protruding from the side surface of the main body part near the extended part and supporting the percussion instrument to restrict a displacement of the main body part in a state that the extended part is tightened together with the hoop by the one of the plurality of tension bolts, the hoop comprises a plurality of flange parts respectively extending in a flange shape outward in the radial direction to be locked to the plurality of tension bolts, and the restricting part comprises a flange supporting part, which touches one of the plurality of flange parts at two sides in a circumferential direction with the one of the plurality of tension bolts therebetween in the state that the extended part is tightened together with one of the plurality of flange parts of the hoop by the one of the tension bolts.

16. The percussion attachment according to claim 15, wherein:

the restricting part comprises a bolt supporting part, which is formed lower than the extended part and comprises an elastic part that is made of an elastic material and touches the one of the plurality of tension bolts in the state that the extended part is tightened together with the hoop by the one of the plurality of tension bolts, and the flange supporting part comprises a pressure contact part, which is made of an elastic material and is in pressure contact with the one of the plurality of flange parts in the state that the extended part is tightened together with the hoop by the one of the plurality of tension bolts, wherein the elastic part and the pressure contact part are integrally formed using the same elastic material, and a gap is formed between the pressure contact part and the main body part.

* * * * *